US005756271A

United States Patent [19]

Opitz et al.

[11] Patent Number: 5,756,271

[45] Date of Patent: May 26, 1998

[54] WEAKLY ALKALINE ASCORBIC ACID DEVELOPING COMPOSITION, PROCESSING KIT AND METHOD USING SAME

[75] Inventors: Robert John Opitz; Silvia Zawadzki, both of Rochester, N.Y.

[73] Assignee: Eastman Kodak Company, Rochester, N.Y.

[21] Appl. No.: 863,830

[22] Filed: May 27, 1997

Related U.S. Application Data

[62] Division of Ser. No. 674,497, Jun. 28, 1996, Pat. No. 5,702,875.

[51] Int. Cl.[6] ..... G03C 5/30

[52] U.S. Cl. ..... 430/465; 430/440; 430/446; 430/480; 430/483; 430/492

[58] Field of Search ..... 430/465, 480, 430/483, 492

[56] References Cited

U.S. PATENT DOCUMENTS

| | | | |
|---|---|---|---|
| 2,688,549 | 9/1954 | James et al. | 430/480 |
| 3,453,109 | 7/1969 | Lee | 430/325 |
| 3,826,654 | 7/1974 | Weiss et al. | 430/440 |
| 3,865,591 | 2/1975 | Katz . | |
| 3,942,985 | 3/1976 | Newman et al. | 96/66.3 |
| 5,098,819 | 3/1992 | Knapp | 430/436 |
| 5,196,298 | 3/1993 | Meeus et al. | 430/440 |
| 5,204,230 | 4/1993 | Hayashi | 430/465 |
| 5,236,816 | 8/1993 | Purol et al. | 430/492 |
| 5,264,323 | 11/1993 | Purol et al. | 430/364 |
| 5,278,035 | 1/1994 | Knapp | 430/452 |
| 5,376,510 | 12/1994 | Parker et al. | 430/466 |
| 5,384,232 | 1/1995 | Bishop et al. | 430/440 |
| 5,457,011 | 10/1995 | Lehr et al. | 430/488 |
| 5,474,879 | 12/1995 | Fittermann et al. | 430/487 |
| 5,498,511 | 3/1996 | Yamashita et al. | 430/496 |
| 5,503,965 | 4/1996 | Okutsu | 430/399 |
| 5,618,653 | 4/1997 | Vaes et al. | 430/465 |

FOREIGN PATENT DOCUMENTS

| | | |
|---|---|---|
| 531 582 | 3/1993 | European Pat. Off. . |
| 552 511 A1 | 7/1993 | European Pat. Off. . |
| 573 700 | 12/1993 | European Pat. Off. . |
| 585 792 | 3/1994 | European Pat. Off. . |
| 588 408 | 3/1994 | European Pat. Off. . |
| 601 415 | 6/1994 | European Pat. Off. . |
| 603 586 | 6/1994 | European Pat. Off. . |
| 092625 | 9/1993 | Japan . |
| 7-077781 | 9/1993 | Japan . |
| 7-56286 | 3/1995 | Japan . |
| 7-104440 | 4/1995 | Japan . |
| 875 453 | 8/1961 | United Kingdom . |
| 2 292 813 | 3/1996 | United Kingdom . |
| 95/00881 | 1/1995 | WIPO . |
| 96-03677 | 2/1996 | WIPO . |

OTHER PUBLICATIONS

Research Disclosure, pub. 37152, Mar., 1995.

*Primary Examiner*—Hoa Van Le
*Attorney, Agent, or Firm*—J. Lanny Tucker

[57] ABSTRACT

A black-and-white developing composition includes as ascorbic acid developing agent, an auxiliary super-additive developing agent, borate buffer and a preservative. The composition pH is from 7 but less than 9. The composition can be formulated from two separately packaged parts that may be in dry or liquid form. The borate buffer is present to maintain the desired pH, and the two developing agents are present in desired molar ratios for optimal developing activity. Improved photographic properties are obtained while avoiding the use of environmentally unfriendly dihydroxybenzenes.

8 Claims, No Drawings

WEAKLY ALKALINE ASCORBIC ACID DEVELOPING COMPOSITION, PROCESSING KIT AND METHOD USING SAME

This is a Divisional of application Ser. No. 08/674,497, filed Jun. 28, 1996 U.S. Pat. No. 5,702,875.

FIELD OF THE INVENTION

This invention relates in general to photography and in particular to an improved ascorbic acid black-and-white developing composition that is free of dihydroxybenzene developing agents. It also relates to a developing kit and a method of using the developing composition.

BACKGROUND OF THE INVENTION

Photographic developing compositions containing a silver halide developing agent are well known in the art for reducing silver halide grains containing a latent image to yield a developed photographic image. Many useful developing agents are known in the art, with hydroquinone and similar dihydroxybenzene compounds being some of the most common.

While dihydroxybenzenes (such as hydroquinone) generally provide development, with or without various known booster and nucleating compounds or auxiliary developing agents, they are disadvantageous from technical, ecological and environmental considerations. For example, hydroquinone solutions are not completely stable in air, being prone to aerial oxidation. The by-products of the instability are often insoluble, black, tarry materials that contaminate the processing solutions and equipment.

The oxidation of hydroquinones also leads to higher pH which in turn leads to increased developer activity. Images can be thusly produced faster, so the processing time must be reduced. The net effect is less control of the process, and less desirable sensitometric properties in the processed materials.

In addition, hydroquinones have become of increasing concern in recent years from the point of view of potential toxicity and environmental pollution.

Another class of developing agents described in several publications, including U.S. Pat. No. 5,236,816 (Purol et al), include ascorbic acid and various derivatives and salts thereof. Although developing compositions containing ascorbic acid are more environmentally friendly, they generally are at higher pH (at least 9.5), and contain various components that can also place considerable oxygen demand on the environment.

Moreover, most developing compositions are formulated as concentrated liquid solutions so the user must dilute them to working strength. Such solutions cannot be concentrated significantly, because of the various components therein, without the use of auxiliary solvents that are preferably to be avoided.

One way to reduce the packaging needs is to formulate the composition as a pre-measured solid. The user then dissolves the solid composition in the proper amount of water to provide a developer solution. In practice, this presents major problems in processing continuous tone black-and-white camera speed films. Because of the low pH of these solutions (7 to 9), the solid compositions are often not readily soluble in water at ambient temperature, and thus must be heated considerably to effect complete solution. The higher temperature however increases aerial oxidation of the developing agent and formation of undesirable by-products. Moreover, this is quite time consuming for the heating and subsequent cooling of the solutions.

Yet there is a desire to be able to formulate such compositions in either dry or aqueous form while avoiding the problems noted above. It would also be preferable to minimize packaging and to provide a solid formulation that does not need to be heated to complete solubility and which does not diminish photographic properties of the processed black-and-white camera speed films.

Although there have been some attempts to solve these problems in the art with ascorbic acid type developing agents, the results have not been totally satisfactory. For example, U.S. Pat. No. 5,098,819 (Knapp) describes the use of ascorbic acid developing solutions containing carbonate buffer to maintain the pH at from 9.75 to 10.6. This pH range is not desirable, and the reference does not address the solubility problems encountered with solid formulations formulated for lower pH. Similar liquid developer formulations are also described in U.S. Pat. No. 5,498,511 (Yamashita et al), U.S. Pat. No. 5,384,232 (Bishop et al) and EP-A-0 603 586 (Parker et al) which are directed to graphic arts imaging as opposed to continuous tone camera speed films.

There is a need to provide a black-and-white developing composition that does not have the problems noted above, and that can be formulated in dry or aqueous form.

SUMMARY OF THE INVENTION

The present invention overcomes the problems noted above with an aqueous black-and-white developing composition that is free of dihydroxybenzene developing agents, the developing composition having a pH of greater than 7 but less than 9, and comprising:

an ascorbic acid developing agent, an auxiliary super-additive developing agent, borate as the sole buffer in an amount of at least 0.001 mol/l, and a preservative, wherein the molar ratio of the ascorbic acid developing agent to the auxiliary super-additive developing agent is at least about 10:1.

This invention also provides a photographic black-and-white developing kit having first and second separately packaged formulations, at least one formulation being packaged in dry form, and each formulation being free of dihydroxybenzene developing agents:

wherein the first packaged formulation comprises an ascorbic acid developing agent, and a first preservative, wherein the molar ratio of the first preservative to the ascorbic acid developing agent is at least 4:1, and the second packaged formulation comprises an auxiliary super-additive developing agent, and a second preservative, wherein the molar ratio of the second preservative to the auxiliary super-additive developing agent is at least 4:1, provided that when the first and second packaged formulations are dissolved in 1 liter of water, the ratio of ascorbic acid developing agent to the auxiliary super-additive developing agent is at least about 10:1, and further provided that a borate buffer can be present as the sole buffer in either or both of the first and second packaged formulations in an amount sufficient to maintain a pH of from 7 and up to 9 when the first and second packaged formulations are mixed in water.

Further, a method of processing to provide a black and white photographic image comprises:

developing an imagewise exposed black and white silver halide photographic material with the aqueous black-and-white developing composition described above.

The invention also provides a method of processing to provide a photographic image comprises:

A) preparing a black-and-white developing composition that has a pH of from 7 and up to 9, from the photographic developing kit described above, and B) developing an imagewise-exposed black-and-white silver halide photographic material with the black-and-white developing solution.

The developing composition of this invention is free of hydrocuinone and other dihydroxybenzene compounds. The composition can be readily formulated, shipped and stored as stable aqueous or readily soluble powder formulations because they have excellent long term stability. The powders readily dissolve in water at room temperature (that is, no heating is required).

The compositions of this invention can be used in a variety of processors to develop various black-and-white films and papers and need no special replenisher. It has been observed that the properly replenished developer composition of this invention has less degradation by-products over time and can be used for a longer running time. It has also been unexpectedly found that the developing compositions provide up to one-third to one-half stop in real speed improvement over hydroquinone developing compositions. Granularity is also reduced, and most films show about 10% more enlargeability.

Importantly, in aqueous formulations, the compositions are weakly alkaline, that is having a stable pH below 9, and thus avoid the problems of more highly alkaline developing compositions.

All of these advantages are provided by formulating the composition to have a pH of at least 7 and up to, but less than 9, using a borate as the only buffer instead of the common carbonate or phosphate buffers or mixtures thereof.

DETAILED DESCRIPTION OF THE INVENTION

Ascorbic acid developing agents are described in a considerable number of publications in photographic processes, including U.S. Pat. No. 5,236,816 (noted above) and references cited therein. Useful ascorbic acid developing agents include ascorbic acid and the analogues, isomers and derivatives thereof. They include, but are not limited to, D,L-ascorbic acid, sugar-type derivatives thereof (such as sorboascorbic acid, γ-lactoascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described for example in U.S. Pat. No. 5,498,511 (Yamashita et al), EP-A-0 585,792 (published Mar. 9, 1994), EP-A-0 573 700 (published Dec. 15, 1993), EP-A-0 588 408 (published Mar. 23, 1994), WO 95/00881 (published Jan. 5, 1995), U.S. Pat. Nos. 5,089,819 and 5,278,035 (both of Knapp), U.S. Pat. No. 5,384,232 (Bishop et al), U.S. Pat. No. 5,376,510 (Parker et al), Japanese Kokai 7-56286 (published Mar. 3, 1995), U.S. Pat. No. 2,688,549 (James et al), U.S. Pat. No. 5,236,816 (noted above) and *Research Disclosure*, publication 37152, March 1995. D- or L-, a mixture of D,L-ascorbic acid (and alkali metal salts thereof) or isoascorbic acid (or alkali metal salts thereof) are preferred. Sodium ascorbate and sodium isoascorbate are most preferred. Mixtures of these developing agents can be used if desired.

The developing composition of this invention also includes one or more auxiliary super-additive developing agents, which are also well known (e.g., Mason, *Photographic Processing Chemistry*, Focal Press, London, 1975). Super-additivity refers to a synergistic effect whereby the combined activity of a mixture of two developing agents is greater than the sum of the two activities when each agent is used alone in the same solution.

Any auxiliary super-additive developing agent can be used, but the 3-pyrazolidone developing agents are preferred (also known as "phenidone" type developing agents). Such compounds are described, for example, in U.S. Pat. No. 5,236,816 (noted above). The most commonly used compounds of this class are 1-phenyl-3-pyrazolidone, 1-phenyl-4,4-dimethyl-3-pyrazolidone, 4-methyl-4-hydroxymethyl-1-phenyl-3-pyrazolidone and 1-phenyl-4,4-dihydroxymethyl-3-pyrazolidone. A most preferred compound is 4-methyl-4-hydroxymethyl-1-phenyl-3-pyrazolidone.

Less preferred auxiliary super-additive developing agents include aminophenols such as p-aminophenol, o-aminophenol, N-methylaminophenol, 2,4-diaminophenol hydrochloride, N-(4-hydroxyphenyl)glycine, p-benzylaminophenol hydrochloride, 2,4-diamino-6-methylphenol, 2,4-diaminoresorcinol and N-(beta-hydroxyethyl)-p-aminophenol.

A mixture of different types of auxiliary super-additive developing agents can also be used if desired.

Borate is used as the only buffer in this invention. It can be used in any suitable form, including boric acid, sodium metaborate, potassium metaborate, sodium tetraborate, potassium tetraborate and other forms readily apparent to one skilled in the art. Mixtures of such compounds can be used if desired. Borate is not required in the developer composition, but is preferably present at up to 0.2 mol/l, and more preferably at from 0.001 to 0.16 mol/l.

The developing composition also includes one or more preservatives or antioxidants. Various conventional black-and-white preservatives can be used including sulfites. A "sulfite" preservative is used herein to mean any sulfur compound that is capable of forming or providing sulfite ions in aqueous alkaline solution. Examples include, but are not limited to, alkali metal sulfites, alkali metal bisulfites, alkali metal metabisulfites, amine sulfur dioxide complexes, sulfurous acid and carbonyl- bisulfite adducts. Mixtures of these materials can also be used.

Examples of preferred sulfites include sodium sulfite, potassium sulfite, lithium sulfite, sodium bisulfite, potassium bisulfite, sodium metabisulfite, potassium metabisulfite and lithium metabisulfite. The carbonyl-bisulfite adducts that are useful include alkali metal or amine bisulfite adducts of aldehydes and bisulfite adducts of ketones. Examples of these compounds include sodium formaldehyde bisulfite, sodium acetaldehyde bisulfite,. succinaldehyde bis-sodium bisulfite, sodium acetone bisulfite, beta-methyl glutaraldehyde bis-sodium bisulfite, sodium butanone bisulfite, and 2,4-pentandione bis-sodium bisulfite.

The developing composition can contain other additives including various metal ion sequestering agents (such as complex phosphates, hydroxy acids and aminocarboxylic acids), antifoggants, non-super-additive developing agents, development restrainers, development accelerators, swelling control agents, stabilizing agents, and development boosters in conventional amounts. Examples of such optional components are described in U.S. Pat. Nos. 5,236,816, 5,474,879 (Fitterman et al), Japanese Kokai 7-56286 and EP-A-0 585 792 (all noted above). Particularly useful sequestering agents include ethylenediaminetetraacetic acid, diethylenetriaminepentaacetic acid, 1,3-propylenediaminetetraacetic acid, 1,3-diamino-2-propanoltetraacetic acid, ethylenediaminodisuccinic acid and ethylenediaminomonosuccinic acid. The sequestering agents can be present in an amount of from 0 to about 0.02 mol/l.

The developing compositions are free of hydroquinone and other dihydroxybenzene compounds, meaning that they are either completely free of such compounds, or contain so little of such compounds that those compounds provide no silver halide developing activity.

The pH of the developing composition of this invention is weakly alkaline, that is at least 7 and up to, but not including 9. Preferably, the pH is from 8 to 8.5, and more preferably, it is from 8.0 to 8.4.

When formulated in an aqueous solution, the developing composition includes the essential components in the following amounts:

the ascorbic acid developing agent at from about 0.01 to about 0.1 mol/l, and preferably from about 0.02 to about 0.07 mol/l, the auxiliary super-additive developing agent at from about $2.5\times10^{-4}$ to about $2.5\times10^{-2}$ mol/l, and preferably from about $5\times10^{-4}$ to about $2\times10^{-3}$ mol/l, borate buffer in an amount of up to 0.2 mol/l, and preferably from about 0.001 to about 0.16 mol/l, and preservative at from about 0.4 to about 1.6 mol/l, and preferably from about 0.4 to about 0.8 mol/l.

The molar ratio of the ascorbic acid developing agent to the -auxiliary super-additive developing agent is at least abbut 10:1, and preferably, it is from about 20:1 to about 50:1.

As noted above, the developing composition can be formulated as an aqueous solution that can be used directly as the working solution or as the developer replenisher, or it can be in a concentrated solution that is suitably diluted.

Alternatively, the composition can be prepared as a dry powder, pellets, granules or tablets using conventional procedures.

Preferably, the present invention provides a black-and-white developing kit having at least two separately packaged formulations, at least one formulation being packaged in dry form. Each packaged formulation is free of dihydroxybenzene developing agents as described above The first packaged formulation comprises an ascorbic acid developing agent, and a first preservative, wherein the molar ratio of the first preservative to the developing agent is at least 4:1, and preferably from 7:1 to 20:1.

The second packaged formulation comprises the auxiliary super-additive developing agent and a second preservative, wherein the molar ratio of the second preservative to the auxiliary super-additive developing agent is at least 4:1, and preferably from 50:1 to 200:1.

Moreover, when the first and second packaged formulations are dissolved in water for use in processing, the ratio of the ascorbic acid developing agent to the auxiliary super-additive developing agent is at least 10:1, and preferably from about 20:1 to about 50:1.

The borate can be present in either or both packaged formulations (or neither, if separately added) in an amount sufficient to maintain a pH of from 7 and up to 9 when the two formulations are mixed in water. Preferably, the borate buffer is in the second packaged formulation.

Preferably, the first and second preservatives are sulfite ions that can be supplied from the same or different compounds. At least one of the formulations also contains a sequestering agent or any other desired additive.

At least one of the separately packaged formulations is in dry form, such as a fine powder or granules. Preferably, both separately packaged formulations are in dry form. The formulations can generally be dissolved in water in any suitable fashion.

Preferably, the separately packaged formulation containing the auxiliary super-additive developing agent and optional borate buffer is dissolved in water first, followed by the separately packaged formulation containing the ascorbic acid developing agent. Generally, the first dissolved formulation is more alkaline (generally from 9.5 to 11) than the second dissolved formulations but the final pH of both dissolved formulations is within the desired range.

The developing compositions of this invention are useful for forming black-and-white silver images by development of light-sensitive silver halide photographic elements of various types including, but not limited to, microfilms, aerial films, black-and-white motion picture films, duplicating and copy films, and amateur and professional continuous tone black-and-white films. Preferably, the amateur and professional black-and-white films are processed using this invention. The processed materials can have any suitable silver halide emulsion known for this purpose, the details of which are described in *Research Disclosure*, publication 36544, pages 501–541 (September 1994), and U.S. Pat. No. 5,384,232 (noted above). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). Preferred emulsions useful in the invention include silver bromide and silver bromoiodide emulsions (having up to 15 mol % iodide, based on total silver).

In processing the photographic elements, the time and temperature for development can be varied widely. Typically, the temperature will be in the range of from about 18° to about 40 ° C., and the time will range from about 180 seconds to about 20 minutes. More preferably, the temperature can be in the range of from about 20° to about 25° C., and the time at from about 3 to about 10 minutes.

The developing composition of this invention can be used as its own replenishing solution.

Following development, the photographic materials can then be processed with one or more additional steps that are known in the art using conventional processing solutions. Such additional steps include development stop, fixing, washing and drying. The *Research Disclosure* publication, noted above, describes the components of such processing solutions. Typical fixing solutions include a fixing agent, such as a thiosulfate or thioether, and one or more low pH buffers, and sequestering agents. Suitable fixing times and temperatures can be used.

After fixing, the photographic elements are generally washed to remove silver salt dissolved by fixing, at suitable times and temperatures.

Processing according to the present invention can be carried out using conventional tanks, trays and automated processing machines holding processing solutions. Alternatively, it can be carried out using what is known in the art as "low volume thin tank" processing systems using either rack and tank or automatic tray designs. Such processing methods and equipment are described, for example, in U.S. Pat. No. 5,436,118 (Carli et al) and publications cited therein.

The following examples are provided to illustrate the practice of this invention, and are not meant to be limiting in any manner. All percentages are by weight unless otherwise indicated.

EXAMPLE 1

Preferred Developing Kit

The following developing kit having two dry powder formulations was prepared and used to prepare an aqueous black-and-white developing composition, as follows:

| | |
|---|---|
| Part A (Dry Formulation): | |
| Sodium sulfite | 10 g |
| Diethylenetriaminepenta-acetic acid, pentasodium salt | 1 g |
| Sodium metaborate (8 mol) | 4.0 g |
| 4-Hydroxymethyl-4-methyl-1-phenyl-3-pyrazolidone | 0.2 g |
| Part B (Dry Formulation): | |
| Sodium sulfite | 75 g |
| Sodium metabisulfite | 3.5 g |
| Sodium isoascorbate | 12 g |

Part A was dissolved completely in 850 ml of water at room temperature, having a pH of 10.19±0.05. Part B was then dissolved in the solution at room temperature, and water was added to 1 liter. The final pH was 8.20±0.05.

EXAMPLES 2–5

Aqueous Developing Compositions

The following components were formulated into liquid developer compositions of this invention:

| | Example 2 | Example 3 | Example 4 | Example 5 |
|---|---|---|---|---|
| Water | 800 g | 800 g | 800 g | 800 g |
| Sodium hydroxide (50%) | 12.35 g | 16.5 g | 0 | 0 |
| Diethanolamine (with 16% sulfur dioxide) | 75 g | 100.0 g | 15.3 g | 23 g |
| 4-Hydroxymethyl-4-methyl-1-phenyl-3-pyrazolidone | 0.55 g | 0.73 g | 0.67 g | 1.0 g |
| Diethylenetriaminepenta-acetic acid, pentasodium salt (40%) | 2.5 g | 3.3 g | 1.67 g | 2.5 g |
| Sodium metabisulfate | 18.8 g | 25.1 g | 0 | 0 |
| Ascorbic acid | 8.0 g | 10.7 g | 10.0 g | 15.0 g |
| Sodium sulfite | 0 | 0 | 36.0 g | 54.0 g |
| Sodium bicarbonate | 0 | 0 | 13.3 g | 20.0 g |
| Water was added to 1 liter, pH = 8.0 | | | | |

EXAMPLE 6

Processing of Black-and-White Films

Several commercially available black-and-white camera speed films were processed according to the present invention using the following processing protocol:

| | | |
|---|---|---|
| Development | 20° C. | Various times |
| Stop bath | 20° C. | 30 seconds |
| Fixing | 20° C. | 3–10 minutes |
| Washing | 20° C. | 5–20 minutes |
| Drying | | |

A rectangular stainless steel tank, outfitted with a nitrogen sparger for agitation, was used with 8 liters of solution for film processing. During development, nitrogen burst agitation was used one second for every fifteen seconds. The same tanks were used for the stop bath, fixing and washing. The stop bath and fixing solution had the same agitation as the developer solution, but the washing solution was continuously agitated with nitrogen bursts.

Film samples were exposed with a 1-B sensitometer with 55K color temperature and 21-step carbon tablet with a density range of from 0–4 in equal 0.2 increments. The time of development series ranged from 3 to 15 minutes. The samples were evaluated on a visual channel of a densitometer, and the data in the following Table I were interpolated from points thusly generated.

Development was carried out using the developer composition described in Example 1 or commercially available "Control" developers described below. The films were fixed using conventional KODAK RAPID FIXER™, and washed with water.

The two "Control" developers were KODAK D-76™ Developer and KODAK T-MAX™ Developer both containing hydroquinone.

The various black and white films processed in this manner were commercially available from Eastman Kodak Company.

The results of processing the various films are shown in Table I below. The data show that, in comparison to standard hydroquinone-containing developers, such as KODAK D-76™ or KODAK T-MAX™, developers of this type can duplicate results without having to rely upon hydroquinone. Films processed in these developers show enhanced speed, image quality, and tone reproduction at a desired process rate.

TABLE I

| Film | Developer | LogE at ANSI* 0.62 | Exposure Index | Time to CI 0.56 (Normal) | Time to CI 0.82 (+3 Stops) | Dmin at CI 0.56 | Dmin at CI 0.82 |
|---|---|---|---|---|---|---|---|
| KODAK | Example 1 | −2.18 | 125 | 6.6 | 10.5 | 0.20 | 0.23 |
| TMAX | Example 2 | −2.23 | 125 | 6.4 | 16.0 | 0.22 | 0.26 |

TABLE I-continued

| Film | Developer | LogE at ANSI* 0.62 | Exposure Index | Time to CI 0.56 (Normal) | Time to CI 0.82 (+3 Stops) | Dmin at CI 0.56 | Dmin at CI 0.82 |
|---|---|---|---|---|---|---|---|
| 100 ™ | Example 3 | −2.22 | 125 | 5.6 | 11.0 | 0.22 | 0.25 |
| | Example 4 | −2.14 | 100 | 4.3 | 8.6 | — | — |
| | Example 5 | −2.20 | 125 | 4.1 | 7.5 | — | — |
| | D-76 | −2.10 | 100 | 6.7 | 10.2 | 0.22 | 0.27 |
| | T-MAX | −2.26 | 160 | 6.7 | 11.6 | 0.23 | 0.27 |
| KODAK | Example 1 | −2.75 | 400 | 6.3 | 9.5 | 0.23 | 0.26 |
| TMAX | Example 2 | −2.84 | 500 | 7.5 | 12.0 | 0.24 | 0.27 |
| 400 ™ | Example 3 | −2.84 | 500 | 6.4 | 10.0 | 0.24 | 0.26 |
| | Example 4 | −2.90 | 640 | 5.1 | 8.0 | — | — |
| | D-76 | −2.76 | 500 | 7.6 | 11.0 | 0.24 | 0.25 |
| | T-MAX | −2.79 | 500 | 6.0 | 9.5 | 0.26 | 0.30 |
| KODAK | Example 1 | −3.00 | 800 | 8.0 | 12.0 | 0.27 | 0.31 |
| TMAX | Example 2 | −3.15 | 1250 | 9.0 | 14.0 | 0.35 | 0.39 |
| P3200 ™ | Example 3 | −3.16 | 1250 | 8.0 | 12.0 | 0.33 | 0.38 |
| | D-76 | −3.00 | 800 | 9.6 | 14.0 | 0.33 | 0.38 |
| | T-MAX | −3.05 | 1000 | 7.4 | 11.3 | 0.34 | 0.40 |
| KODAK | Example 1 | −2.80 | 500 | 7.0 | 11.0 | 0.27 | 0.29 |
| TRI-X- | Example 2 | −2.80 | 500 | 7.5 | 16.0 | 0.28 | 0.30 |
| PAN ™ | Example 3 | −2.80 | 500 | 6.6 | 13.5 | 0.29 | 0.31 |
| | Example 4 | −2.83 | 500 | 5.4 | 10.5 | — | — |
| | D-76 | −2.65 | 400 | 6.5 | 12.0 | 0.26 | 0.28 |
| | T-MAX | −2.77 | 500 | 6.7 | 12.0 | 0.32 | 0.36 |
| KODAK | Example 1 | −2.37 | 200 | 6.5 | 12.0 | 0.33 | 0.35 |
| PLUS- | Example 2 | −2.28 | 160 | 12.0 | — | 0.32 | — |
| X-PAN ™ | Example 3 | −2.33 | 160 | 8.4 | — | 0.32 | — |
| | D-76 | −2.20 | 125 | 5.6 | 12.0 | 0.30 | 0.32 |
| | T-MAX | −2.34 | 160 | 6.2 | — | 0.42 | — |

*Log E at ANSI 0.62 was calculated according to the standard ISO method. Exposure Index (EI) was determined from this using the ISO method and tables [See American National Standards Institute, ISO 6, Publication No. 1993 (E)].
"CI" refers to Contrast Index as defined in "KODAK Professional Black and White Films", Kodak Publication F-5, Eastman Kodak Company, 1990, pages 14–24.

The invention has been described in detail with particular reference to preferred embodiments thereof, but it will be understood that variations and modifications can be effected within the spirit and scope of the invention.

We claim:

1. A photographic black-and-white developing kit having first and second separately packaged formulations, at least one formulation being packaged in dry form, and each formulation being free of dihydroxybenzene developing agents:

wherein said first packaged formulation comprises an ascorbic acid developing agent, and a first preservative, wherein the molar ratio of said first preservative to said ascorbic developing agent is at least 4:1, and said second packaged formulation comprises an auxiliary super-additive developing agent, and a second preservative, wherein the molar ratio of said second preservative to said auxiliary super-additive developing agent is at least 4:1, provided that when said first and second packaged formulations are dissolved in 1 liter of water, the ratio of ascorbic acid developing agent to said auxiliary super-additive developing agent is at least about 10:1, and further provided that a borate buffer can be present as the sole buffer in either or both of said first and second packaged formulations in an amount sufficient to maintain a pH of from 7 and up to 9 when said first and second packaged formulations are mixed in water.

2. The developing kit of claim 1 wherein said ascorbic acid developing agent is D- or L-ascorbic acid, isoascorbic acid, an alkali metal salt of any of these compounds, or a mixture thereof, and said auxiliary super-additive developing agent is 4-hydroxymethyl-4-methyl-1-phenyl-3-pyrazolidone, 1-phenyl-3-pyrazolidone, 4,4-dimethyl-1-phenyl-3-pyrazolidone, or 1-phenyl-4,4-dihydroxymethyl-3-pyrazolidone.

3. The developing kit of claim 1 wherein the molar ratio of said first preservative to said ascorbic acid developing agent in said first packaged formulation is from about 7:1 to about 20:1, and the molar ratio of said second preservative to said auxiliary super-additive developing agent in said second packaged formulation is from about 50:1 to about 200:1.

4. The developing kit of claim 1 wherein said borate buffer is present in said second packaged formulation.

5. The developing kit of claim 1 wherein said first and second preservative is sulfite ion.

6. The developing kit of claim 1 wherein both said first and second packaged formulations are dry formulations.

7. The photographic developing kit of claim 1 wherein at least one packaged formulation further comprises a sequestering agent.

8. A method of processing to provide a photographic image comprising:

A) preparing a black-and-white developing composition that has a pH of from 7 and up to 9, from a photographic developing kit having at least two separately packaged formulations, at least one formulation being packaged in dry form, and each formulation being free of dihydroxybenzene developing agents, said separately packaged formulations comprising:

a first packaged formulation comprising an ascorbic acid developing agent, and a first preservative, wherein the molar ratio of said first preservative to said ascorbic acid developing agent is at least 4:1 and a second packaged formulation comprising an auxiliary super-additive developing agent, and a second preservative, wherein the molar ratio of said second preservative to said auxiliary super-additive developing agent is at least 4:1, provided that when said first and second packaged formulations are dissolved in 1 liter of water, the ratio of said ascorbic acid developing agent to said auxiliary super-additive developing agent is at least about 10:1, and further provided that a borate buffer is present as the sole buffer in said developing composition in an amount of at least about 0.001 mol/l, and B) developing an imagewise-exposed black-and- white silver halide photographic material with said black-and-white developing solution.

* * * * *